US006886890B2

(12) United States Patent
Rowland et al.

(10) Patent No.: US 6,886,890 B2
(45) Date of Patent: May 3, 2005

(54) PANEL

(76) Inventors: David L. Rowland, 739 Park Blvd., Marion, VA (US) 24354; Erwin W. Rowland, 739 PArk Blvd., Marion, VA (US) 24354

( * ) Notice: Subject to any disclaimer, the term of this patent is extended or adjusted under 35 U.S.C. 154(b) by 0 days.

(21) Appl. No.: 10/165,498

(22) Filed: Jun. 7, 2002

(65) Prior Publication Data

US 2003/0227211 A1 Dec. 11, 2003

(51) Int. Cl.[7] ..... A47C 7/02

(52) U.S. Cl. ..... 297/452.56; 297/440.11; 297/228.1; 297/228.13

(58) Field of Search ..... 297/440.11, 452.56, 297/228.1, 228.11, 228.12, 228.13

(56) References Cited

U.S. PATENT DOCUMENTS

| | | | | |
|---|---|---|---|---|
| 2,108,242 A | | 2/1938 | Wallace | |
| 3,235,306 A | * | 2/1966 | Chrenivsky | 297/296 |
| 3,372,406 A | | 3/1968 | Heckethorn | |
| 3,528,763 A | | 9/1970 | Runton | |
| 3,589,967 A | | 6/1971 | Shirakawa | |
| 3,736,022 A | | 5/1973 | Radke | |
| 3,794,382 A | * | 2/1974 | Bloomfield et al. | 297/452.13 |
| 4,036,524 A | | 7/1977 | Takamatsu | |
| 4,047,756 A | | 9/1977 | Ney | |
| 4,062,589 A | | 12/1977 | Klein et al. | |
| 4,601,516 A | * | 7/1986 | Klein | 297/440.11 |
| 4,685,727 A | * | 8/1987 | Cremer et al. | 297/180.14 |
| 4,782,883 A | | 11/1988 | Braiotta | |
| 5,203,611 A | * | 4/1993 | Greenwood | 297/440.11 |
| 5,222,998 A | | 6/1993 | Ferrari et al. | |
| 5,288,136 A | | 2/1994 | Webber et al. | |
| 5,393,126 A | | 2/1995 | Boulva | |
| 5,560,683 A | | 10/1996 | Penley et al. | |
| 5,762,403 A | * | 6/1998 | Robinson | 297/440.11 |
| 6,050,646 A | * | 4/2000 | Stenzel et al. | 297/452.59 |
| 6,079,779 A | | 6/2000 | Tanaka et al. | |
| 6,254,190 B1 | * | 7/2001 | Gregory | 297/452.1 |
| 6,295,925 B1 | | 10/2001 | Sarni et al. | |
| 6,345,428 B2 | | 2/2002 | Apissomian | |
| 6,386,634 B1 | | 5/2002 | Stumpf et al. | |
| 6,439,665 B1 | | 8/2002 | Cvek | |
| 2001/0038234 A1 | | 11/2001 | Drira | |

FOREIGN PATENT DOCUMENTS

| | | |
|---|---|---|
| WO | WO 02/34182 | 5/2002 |

* cited by examiner

*Primary Examiner*—Peter M. Cuomo
*Assistant Examiner*—Joseph Edell
(74) *Attorney, Agent, or Firm*—Gable and Gotwals; Michael E. Sellers

(57) ABSTRACT

A panel having particular utility in a chair or other apparatus for receiving an occupant in a seated position includes an envelope of resilient material having an opening with a fastener for closing the envelope. An envelope support frame is substantially rigid and formed in a closed loop. The envelope support frame is positioned inside the envelope to tension the resilient material of the envelope in one or more tension zones. A fastener is closed to envelop the envelope support frame with the resilient material. The width of each tension zone when the envelope is in a its relaxed state is different than the width of each immediately adjacent tension zone.

16 Claims, 5 Drawing Sheets

10
12
14
16
18
9
9
18

PANEL

FIELD OF THE INVENTION

The present invention relates generally to panels. More particularly, the present invention relates to a fabric panel for use in items such as chairs, furniture, and luggage.

BACKGROUND OF THE INVENTION

Chairs, furniture and other articles typically include rigid panels which may serve various purposes. For example, many chairs are constructed of seat and backrest panels which are formed or molded substrates onto which a padded composite structure is attached. The chair panels are designed to support the weight of an occupant of the chair with the foam padding being used to provide comfort to the occupant. However, such panels are often bulky and can significantly increase the chair's overall weight while decreasing the chair's stacking/storage density. Solid surface chair panels also provide very little breathability, which contributes negatively to the comfort of the occupant.

Furniture such as dressers and so-called "entertainment centers" are usually constructed of wood panels having a laminated and/or varnished exterior finish. These wood panels add tremendous weight to the furniture. Additionally, wood finishes are notoriously susceptible to damage. Most wood furniture panels are not designed to be easily removed and replaced with a new and undamaged panel, so the furniture's wood finish must be maintained in order to keep an aesthetically pleasing appearance.

One approach to resolving the disadvantages of prior art chair panels has been to provide a single-layer elastic membrane that is pre-stretched and mounted to a molded frame. However, the manufacture of such a chair is tremendously complicated and requires a very large molding machine. Also, the structural support and user comfort exhibited by the pre-stretched membranes has been found lacking.

What is needed, therefore, is a panel that overcomes problems and disadvantages associated with prior art panels.

SUMMARY OF THE INVENTION

The present invention eliminates the difficulties and disadvantages of the prior art by providing a panel having an envelope fabricated from a resilient material. The envelope includes an opening with a fastener for closing the envelope. A substantially rigid envelope support frame formed in a closed loop is positioned inside the envelope and tensions the resilient material of the envelope in one or more tension zones. The fastener is closed to envelop the envelope support frame with the resilient material.

The panel may be configured to include a plurality of tension zones where each tension zone represents a tension on the resilient material that is different than the tension represented by each immediately adjacent tension zone. Tensions applied in the tension zones may all be in a common direction. Use of multiple tension zones in this manner is particularly suitable for panels that carry significant loads, such as the seat panel of a chair or stool.

The envelope may include a first layer of resilient material in opposed relation to a second layer of resilient material. The second layer of resilient material functions to provide overload support when loading on the first layer is sufficient to bring it into contact with the second layer.

When the panel is to be employed in a chair or other apparatus for receiving an occupant in a seated position, the panel is preferably attached to the chair. This may be accomplished by attaching a seat plate to the chair frame, attaching an envelope support frame plate to the envelope support frame, and attaching the support frame plate to the seat plate with a fastener such as a threaded bolt.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
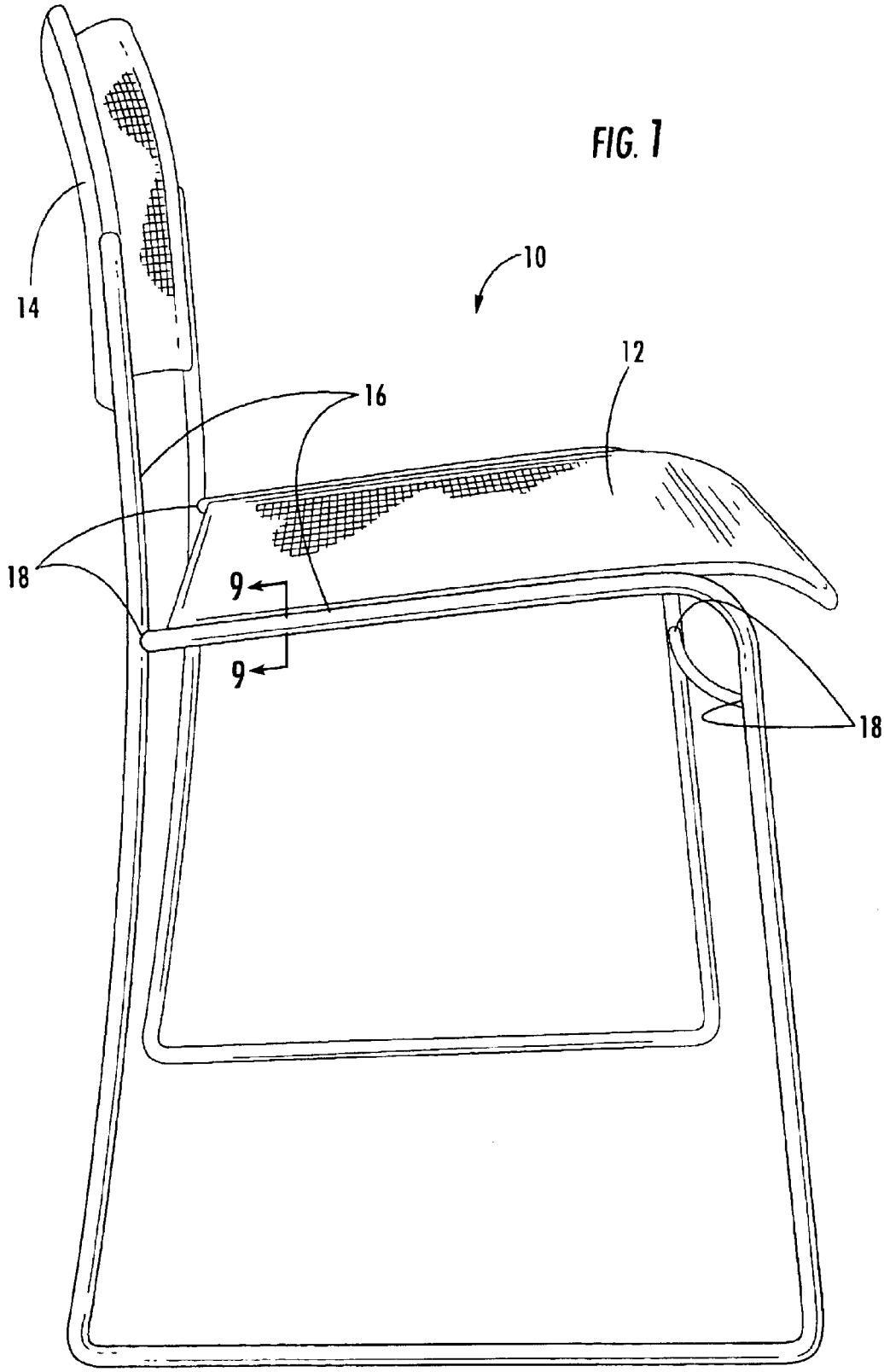
FIG. 1 is a perspective view of a chair having panels according to the present invention.

Preferred embodiments of the present invention will now be described with reference to the accompanying drawings, wherein like reference characters designate like or similar parts throughout. The terminology used herein is intended to be interpreted in its broadest reasonable manner, even though it is being utilized in conjunction with a detailed description of certain specific preferred embodiments of the present invention. This is further emphasized below with respect to some particular terms used herein. Any terminology intended to be interpreted by the reader in any restricted manner will be overtly and specifically defined as such in this specification.

FIG. 1 illustrates a chair 10 incorporating a seat panel 12 and a back rest panel 14 attached to a chair frame 16. The chair frame 16 is fabricated from tubular or rod steel with welds at points 18. The seat panel 12 and back rest panel 14 are fabricated from an envelope of resilient material that is stretchable with an internal sub-frame tensioning the material of the envelope in one or more tension zones of the panel, as more fully described below.

It will be understood that the particular chair style illustrated in FIG. 1 is not limiting and that a panel 12, 14 according to the invention may be employed in a variety of devices whose function is to receive an occupant in a seated position. For example, a panel 12, 14 according to the invention may employed as the seating surface of a stool. Additionally, a panel according to the invention is not limited to use in seating devices, but rather, may be employed in various items of furniture, such as dressers and entertainment centers, that require panels as well as numerous other items including luggage and area dividers/partitions.

Figure 2:
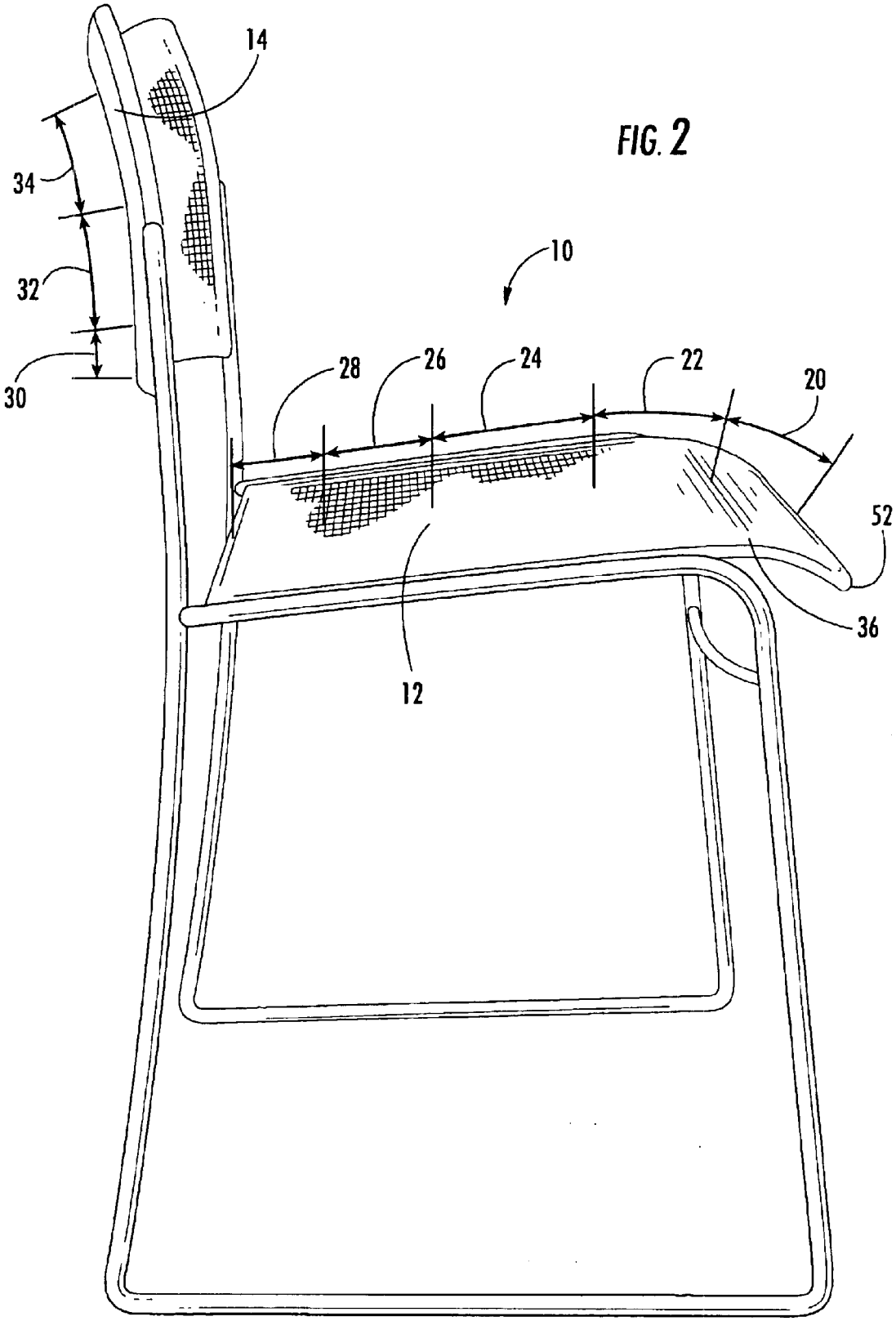
FIG. 2 is a perspective view of the chair of FIG. 1 illustrating various stretch zones in the chair panels.

FIG. 2 illustrates various contiguous tension zones 20–34 representing different loadings or tensions on the resilient material of the panels 12, 14 when an occupant sits in the chair 10. In general, maximum loading is normally experienced in zone 22, which includes the crown 36 of the seat panel 12, and also in zone 26 which includes that portion of the seat panel 12 that supports the occupant's ischial tuberosities. A medium amount of loading is normally experienced in zone 24 where the back of the occupant's thighs are normally supported. Minimal to no loading of the seat panel 12 by the occupant is typically experienced in zones 20 and 28.

With regard to the back rest panel 14, maximum loading by the occupant is normally experienced in zone 32 where the occupant's lumbar region is supported. Minimal to no loading is typically experienced at zones 30 and 34 of the back rest panel 14.

Figure 3:
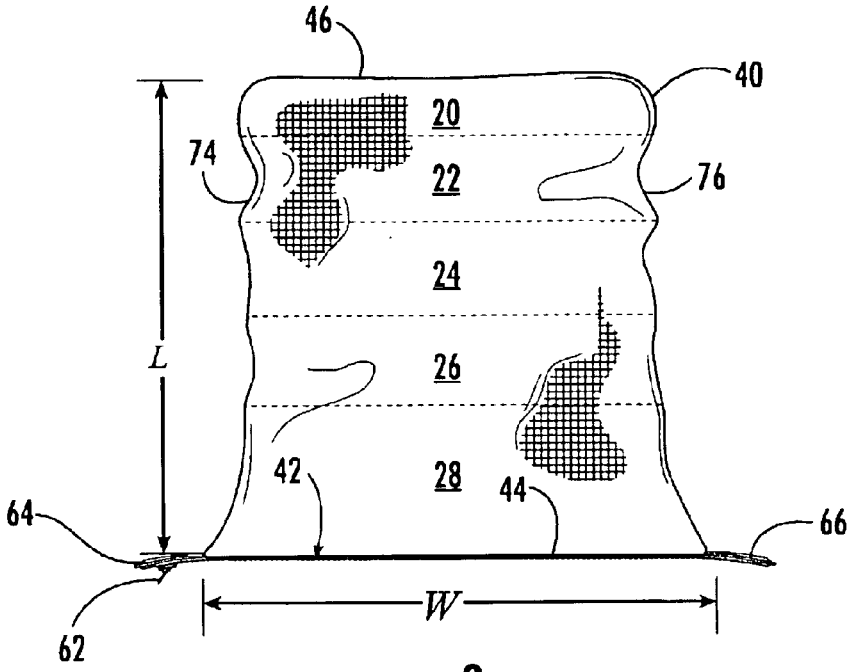
FIG. 3 is plan view of a fabric envelope according to the present invention.

A preferred embodiment of an envelope 40 used for fabrication of a seat panel 12 is shown in FIG. 3. Although not required in the practice of the invention, the envelope 40 is preferably configured to account for the differential loading by an occupant in zones 20–34 of FIG. 2. This can be accomplished by fabricating the envelope 40 from a resilient material that is stretchable. While many such materials are readily available, a particularly suitable material in this regard is available from the Milliken Company under the trade name C-Flex™, which is fabricated from monofiliment fibers having a 672 durometer D-scale value. The C-Flex material has a tensile strength in the warp direction of 156,000 psi and a tensile strength in the filling direction of 194,000 psi. The C-Flex material has the added benefit of high breathability, which significantly enhances occupant comfort.

The envelope 40 is shown in FIG. 3 in its relaxed state and includes an opening generally shown at 42 with a fastener 44, for closing the envelope 40. Fastener 44 can be a hook and loop, sliding track, adhesive, or any other fastener suitable for closing an envelope made from a resilient material. The envelope 40 has a width W at the opening 42 that tapers or narrows towards the distal end 46 along at least a portion of the length L of the envelope 40. The fastener 44, being essentially non-stretchable, is made to approximate the width W of an envelope support frame, or sub-frame 50 (FIGS. 4 and 5) that is positioned within the envelope 40. The relatively narrow body of the envelope 40 results in tension being placed on the envelope's resilient material when the sub-frame 50 is contained within the envelope 40.

Tension placed on the envelope material when the sub-frame is positioned within the envelope 40 may be essentially constant across the length L of the envelope 40. However, in a preferred embodiment as shown in FIG. 3, the envelope 40 is configured so that the level of tension placed on the envelope material with the sub-frame 50 in place varies along the length L of the envelope 40 with each of the different tensions being applied in a common direction. This can be accomplished by varying the width of the relaxed envelope material so that the material is stretched to a greater extent in those portions of the envelope 40 where the width is narrower. For example, the width of the relaxed envelope material in high loading zones 22 and 26 is less than the width in loading zones 20, 24 and 28 where loading is normally less. Also, it is preferable that fabric lines and art work that may be present on the envelope material be deformed commensurate with the contour of the relaxed envelope so that when the sub-frame 50 is positioned within the envelope 40, there is no deformation of the fabric lines or art work in the finished panel 12.

Figure 4:
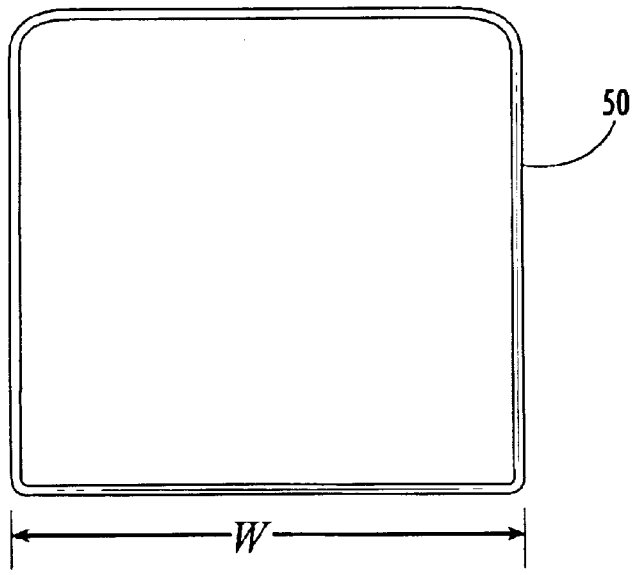
FIG. 4 is plan view of a panel sub-frame according to the present invention.
Figure 5:
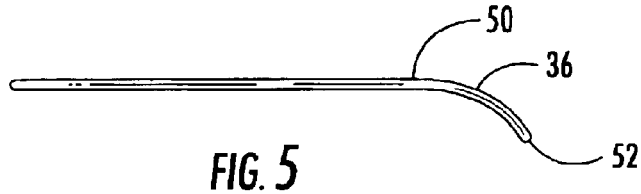
FIG. 5 is a side view of the panel sub-frame of FIG. 4.

With further reference to FIGS. 4 and 5, the envelope of sub-frame 50 is preferably fabricated as a substantially rigid closed loop. The shape and contour of the sub-frame 50 will depend on the particular application. For example, the sub-frame 50 of FIGS. 4 and 5 is for use in the seat panel 12 shown in FIGS. 1 and 2, so this particular sub-frame 50 is curved downward toward the front edge 52 of the seat panel 12 so that a crown 36 is formed. The sub-frame 50 may be fabricated from a substantially rigid material such as steel or titanium.

Figure 6:
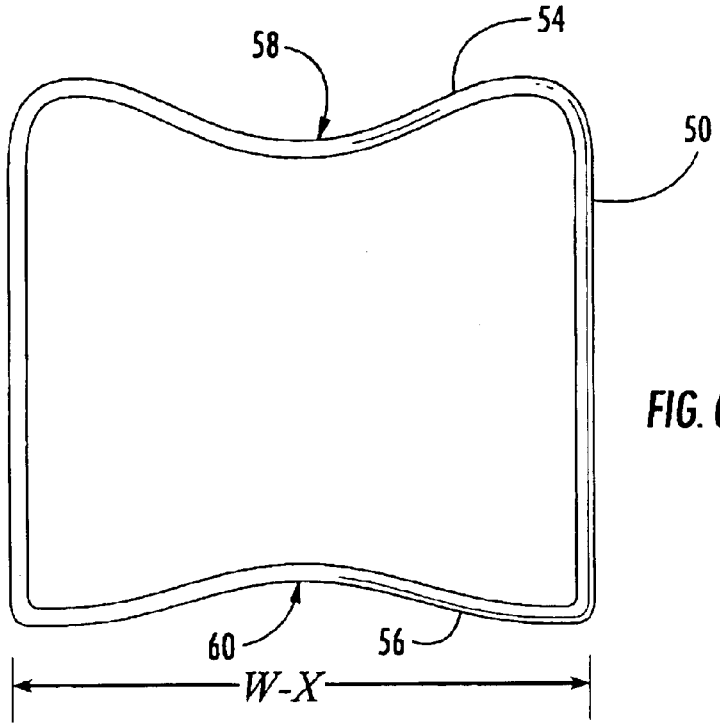
FIG. 6 is a plan view of the panel sub-frame of FIG. 4 illustrating deformation of the panel sub-frame prior to insertion into the fabric envelop of FIG. 3 during fabrication.
Figure 8:
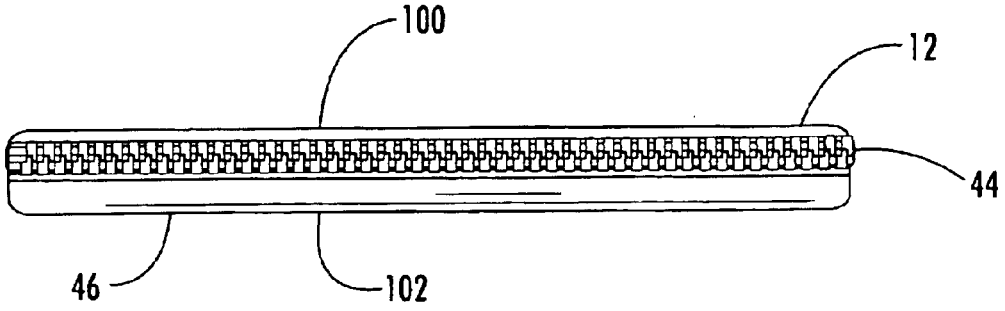
FIG. 8 is an end view of a fabric panel according to the invention.

Various methods may be employed to position the sub-frame 50 within the envelope 40. One such method can be described with reference to FIG. 6. By applying force to opposed sides 54, 56 of the sub-frame 50 in the general direction and position indicated by arrows 58, 60, the width of the sub-frame 50 can be reduced by an amount X so that the width of the sub-frame 50 under deformation becomes W−X. The deformed sub-frame 50 is then positioned in the envelope 40, the sub-frame 50 is released so that the envelope periphery urges against the sub-frame 50, and the fastener 44 (if using a sliding track fastener) is closed with slider 62 (FIG. 3) to envelop the sub-frame 50 within the envelope 40. The ends 64, 66 of the sliding track fastener 44 are then removed and sealed to inhibit inadvertent opening of the fastener 44. An end view of an assembly panel 12 employing a sliding track fastener 44 is shown in FIG. 8. If desired, a cover may be positioned over the closed fastener 44 for aesthetics. Suitable methods for sealing the fastener ends 64, 66 include application of heat to fuse the fastener ends 64, 66 closed, application of an adhesive to adhesively close the fastener ends 64, 66, and use of a staple or any other suitable means for closing the fastener ends 64, 66. If desired, the sliding track fastener 44 may be fabricated from polyester or some other material that can be fused by application of heat along the entire length of the fastener 44 to further inhibit the ability of the fastener 44 to inadvertently open.

Figure 7:
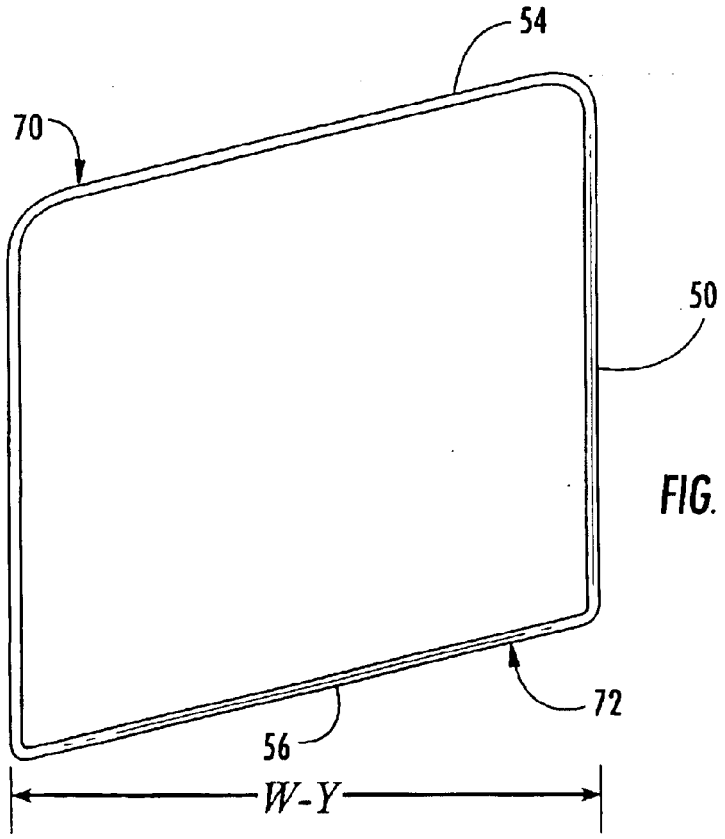
FIG. 7 is a plan view of the panel sub-frame of FIG. 4 illustrating an alternate deformation of the panel sub-frame prior to insertion into the fabric envelope of FIG. 3 during fabrication.

Another method for positioning the sub-frame 50 within the envelope 40 can be described with reference to FIG. 7. By applying force to opposed sides 54, 56 of the sub-frame 50 in the general direction and position indicated by arrows 70, 72, the width of the sub-frame 50 can be reduced by an amount Y so that the width of the sub-frame 50 becomes W−Y. The deformed sub-frame 50 is then slipped in the envelope 40, the sub-frame 50 is released so that the envelope periphery urges against the sub-frame 50, and the fastener 44 is closed to envelop the sub-frame within the envelope 40. If using a sliding track fastener 44, the ends 64, 66 of the fastener 44 are then removed and sealed in accordance with the immediately preceding description.

In yet a further method for positioning the sub-frame 50 within the envelope 40, the envelope 40 is stretched to allow insertion of the sub-frame 50. The deformed envelope 40 is then released so that the periphery of the envelope urges against the sub-frame 50, and the fastener is closed to envelop the sub-frame within the envelope 40. If using a sliding track fastener 44, the ends 64, 66 of the fastener 44 are then removed and sealed in accordance with the above description.

Use of the particular envelope 40 shown in FIG. 3 results in an assembled panel 12 having a plurality of substantially parallel and contiguous tension zones 20–28 where each tension zone represents a tension on the resilient material of the envelope 40 that is different than the tension represented by each immediately adjacent tension zone. In a preferred embodiment of a seat panel 12 for use in a chair 10 of the type shown in FIGS. 1 and 2, tension zone 20 of the assembled panel 12 will have a tension of about 10 pounds per inch or less, tension zone 22 will have a tension of about 65 pounds per inch, tension zone 24 will have a tension within the range of about 30–35 pounds per inch or less, tension zone 26 will have a tension of about 65 pounds per inch, and tension zone 28 will have a tension of about 10 pounds per inch or less, with each of these tensions being applied in a common direction (i.e., for the envelope 40 of FIG. 3, in a direction substantially parallel with end 46). The use of multiple tension zones 20–28 in the panel 12 eliminates the need for additional support structure beneath or behind the high tension areas with little or no detrimental effect to the occupant's comfort.

Referring again to FIG. 8, the assembled panel 12 includes a top layer 100 of resilient material in opposed relation to a bottom layer 102 of resilient material with the bottom layer 102 providing overload support in the event the top layer 100 receives sufficient loading to bring it into contact with the bottom layer 102. In this regard, the two layers 100, 102 complement one another and provide a significant level of redundancy and integrity to the panel 12.

Figure 9:
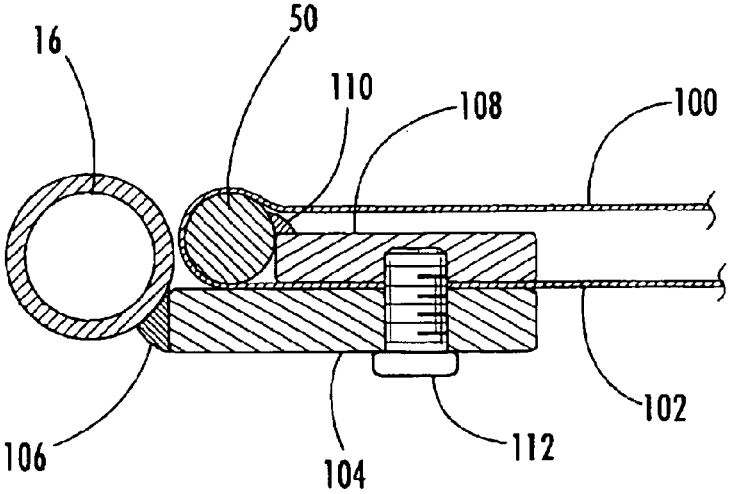
FIG. 9 is a cross-section view of the chair of FIG. 1 taken along section line 9—9.

The assembled panel 12 may be attached to the chair frame 16 in a number of ways. FIG. 9 illustrates how the panel 12 can be attached to the chair frame 16 in accordance with a preferred embodiment. The attachment assembly employs two plates—a chair plate 104 attached to the chair frame 16 by, for example, a weld 106 and a seat plate 108 attached to the sub-frame 50 by a weld 110. The two plates 104, 108 are attached so as to be in alignment with one another when the panel 12 is properly positioned with respect to the chair frame 16. In proper alignment, the two plates 104, 108 are then attached to each other with use of a fastener, such as a threaded bolt 112, weld, adhesive, or other suitable fastener. In a preferred embodiment, a total of four such plate assemblies are used to secure the panel 12 to the chair frame 16.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the above mentioned description is to be considered exemplary, rather than limiting, and the true scope of the invention is that defined in the following claims and any equivalents thereof.

What is claimed is:

1. A panel comprising:

an envelope of resilient material, said envelope having an opening with a fastener for closing the envelope; and an envelope support frame being substantially rigid and formed in a closed loop, said envelope support frame being positioned inside said envelope and tensioning the resilient material of the envelope in a plurality of contiguous tension zones wherein each tension zone is stretched to a predetermined tautness that is different than the tautness of each immediately adjacent tension zone;

wherein said fastener is closed to envelop the envelope support frame with the resilient material.

2. The panel of claim 1 wherein said envelope of resilient material is tensioned in a common direction within each of the tension zones.

3. The panel of claim 1 wherein the tension in a first tension zone is about 65 pounds per inch and the tension in a second tension zone is about 10 pounds per inch or less.

4. The panel of claim 1 wherein the tension in a first tension zone is about 65 pounds per inch and the tension in a second tension zone is about 35 pounds per inch or less.

5. The panel of claim 1 wherein the width of each tension zone when the envelope is in a relaxed state is different than the width of each immediately adjacent tension zone.

6. The panel of claim 1, further comprising a chair frame attached to said envelope support frame.

7. A multi-layer support panel comprising:

an envelope of resilient material, said envelope including:

a first layer of the resilient material in opposed relation to a second layer of resilient material; and an opening with a fastener for closing the envelope; and an envelope support frame being substantially rigid and formed in a closed loop, said envelope support frame being positioned inside said envelope and tensioning each layer of the resilient material of the envelope in a plurality of contiguous tension zones wherein each tension zone is stretched to a predetermined tautness that is different than the tautness of each immediately adjacent tension zone;

wherein said fastener is closed to envelop the envelope support frame with the resilient material, said second layer of resilient material providing overload support when loading on the first layer of resilient material causes said first layer of resilient material to contact the second layer of resilient material.

8. The panel of claim 7 wherein said envelope of resilient material is tensioned in a common direction within each of the tension zones.

9. The panel of claim 7 wherein the tension in a first tension zone is about 65 pounds per inch and the tension in a second zone is about 10 pounds per inch or less.

10. The panel of claim 7 wherein the tension in a first tension zone is about 65 pounds per inch and the tension in a second tension zone is about 35 pounds per inch or less.

11. The panel of claim 7 wherein the width of each tension zone when the envelope is in a relaxed state is different than the width of each immediately adjacent tension zone.

12. The panel of claim 7 further comprising a chair frame attached to said envelope support frame.

13. A support panel comprising:

an envelope of resilient material, said envelope having an opening with a fastener for closing the envelope; and an envelope support frame being substantially rigid and formed in a closed loop, said envelope support frame being positioned inside said envelope and tensioning the resilient material of the envelope in a plurality of substantially parallel tension zones wherein each tension zone is stretched to a predetermined tautness that is different than the tautness of each immediately adjancent tension zone;

wherein said fastener is closed to envelop the envelope support frame with the resilient material.

14. The panel of claim 13 wherein the tension in a first tension zone is about 65 pounds per inch and the tension in a second tension zone is about 10 pounds per inch or less.

15. The panel of claim 13 wherein the tension in a first tension zone is about 65 pounds per inch and the tension in a second tension zone is about 35 pounds per inch or less.

16. The panel of claim 13 wherein the width of each tension zone when the envelope is in a relaxed state is different than the width of each immediately adjacent tension zone.

* * * * *